United States Patent [19]

Wagner

[11] 4,072,174

[45] Feb. 7, 1978

[54] ARRANGEMENT FOR PRODUCING SELVAGE IN WOVEN FABRICS

[75] Inventor: Theodor Wagner, Reutlingen, Germany

[73] Assignee: Firma C.C. Egelhaaf, Reutlingen, Germany

[21] Appl. No.: 698,712

[22] Filed: June 22, 1976

[30] Foreign Application Priority Data

June 25, 1975 Germany ..... 2528246

[51] Int. Cl.[2] ..... D03D 47/40

[52] U.S. Cl. ..... 139/54

[58] Field of Search ..... 139/49, 54

[56] References Cited

U.S. PATENT DOCUMENTS

| | | | |
|---|---|---|---|
| 2,802,488 | 8/1957 | Opletal et al. | 139/54 |
| 3,047,027 | 7/1962 | Snaty et al. | 139/54 |
| 3,741,256 | 6/1973 | Wesseler | 139/54 |
| 3,952,778 | 4/1976 | Volpe | 139/54 |

FOREIGN PATENT DOCUMENTS

| | | | |
|---|---|---|---|
| 2,329,688 | 12/1974 | Germany | 139/54 |

*Primary Examiner*—Henry S. Jaudon

[57] ABSTRACT

In a weaving machine an arrangement for producing selvages in woven fabrics. The arrangement includes a frame which is mounted between the healds and the woven fabric. A plurality of guide needles are pivotally mounted in the frame and are controlled by electromagnets mounted on the frame. The guide needles have eyes through which selvage threads fed from spools are passed. Each guide needle is adapted to independently guide a selvage thread during the weaving process.

3 Claims, 11 Drawing Figures

FIG. 2
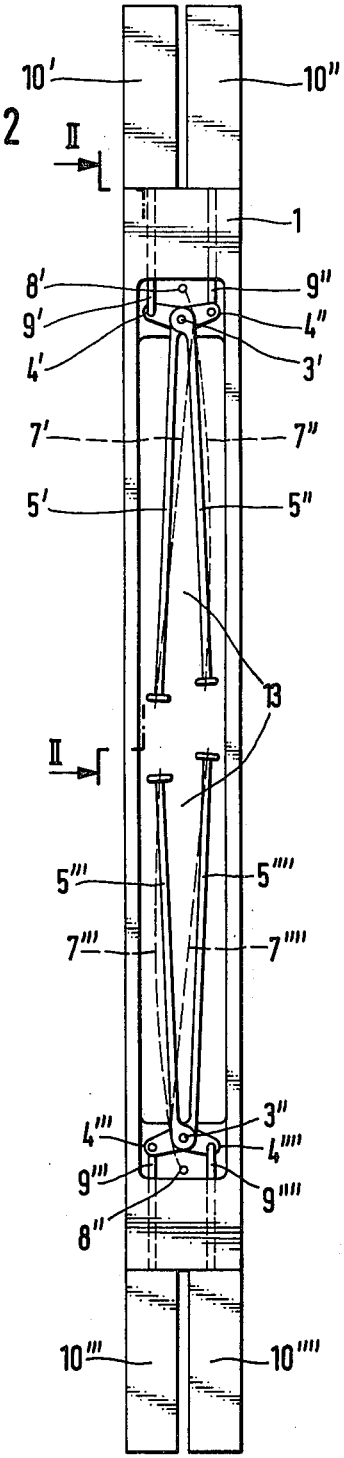
FIG. 3
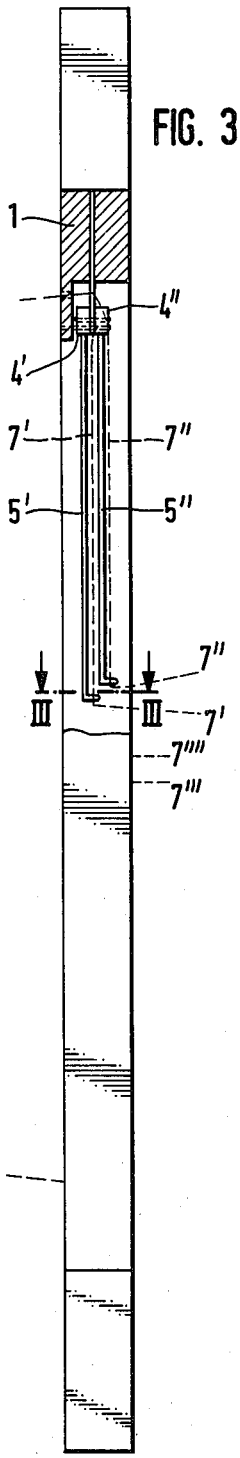
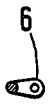
FIG. 4

ARRANGEMENT FOR PRODUCING SELVAGE IN WOVEN FABRICS

BACKGROUND OF THE INVENTION

The invention relates to an arrangement for producing selvage in woven fabrics. The arrangement is advantageously arranged in front of the weave shaft.

The selvage threads are, because of their irregular interweaving paths, advantageously taken of separate spools and are operatively moved by the arrangement, whereas the warp threads are moved by the regular weaving shafts and are in most cases guided by the healds suspended from the frames, which serve for producing the woven material.

There are already known arrangements (German Pat. No. 1,814,269) in which pairs of rigidly connected needles are arranged one above the other. It is possible to produce with such an arrangement oppositely running setting twist selvages. However, due to the rigid connection between the needles of each pair of needles, the adjustability and variability of such an arrangement is very limited.

There is, furthermore, known an arrangement disclosed in German Pat. No. 1,246,619 wherein needles which are adjustably arranged in pairs can produce twist selvages. Here too, the arrangement of pairs of levers provide only a very limited range for setting of the selvage threads for the woven material.

SUMMARY OF THE INVENTION

It is an object of this invention to obtain, by means of selvage threads and regular warp threads a selvage weave pattern.

The arrangement of this invention includes a frame on which a plurality of needles are mutually independently mounted. Each needle guides a selvage thread and can be independently positively controlled.

Such an arrangement makes it possible that the movement of the individual selvage threads is adjusted separately and is adapted to the movement of one or more warp threads in order to provide one or more corresponding selvage patterns.

Such an arrangement makes it possible to control the movement of the individual selvage threads separately and to adapt this movement to one or more warp threads to obtain one or more selvage patterns in accordance with the adjustment of the needles guiding the selvage thread.

BRIEF DESCRIPTION OF THE DRAWING

The invention is further set forth in the following detailed decription taken in conjunction with the appended drawing, in which:

FIG. 2 illustrates a front view of the arrangement of the invention;

FIG. 3 illustrates a side view of the arrangement of the invention partially in section along line II—II in FIG. 2;

FIG. 4 is a cross-sectional view through a needle along line III—III of FIG. 3;

DETAILED DESCRIPTION

Figure 1:
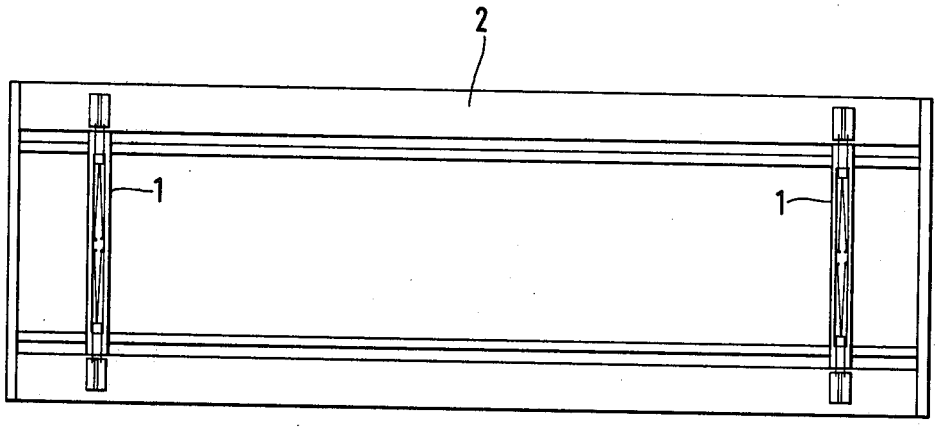
FIG. 1 illustrates two arrangements in accordance with this invention mounted on one weaving shaft frame.

The arrangements 1, in accordance with this invention, can advantageously be arranged on the forward weaving shaft frame 2. As can be noted from FIG. 1 there are mounted the required number of arrangements 1 (illustratively 2 in FIG. 1) on the weaving shaft frame 2. These arrangements 1 can be laterally adjusted on the weaving shaft frame 2 by means not illustrated in detail.

Figure 5:
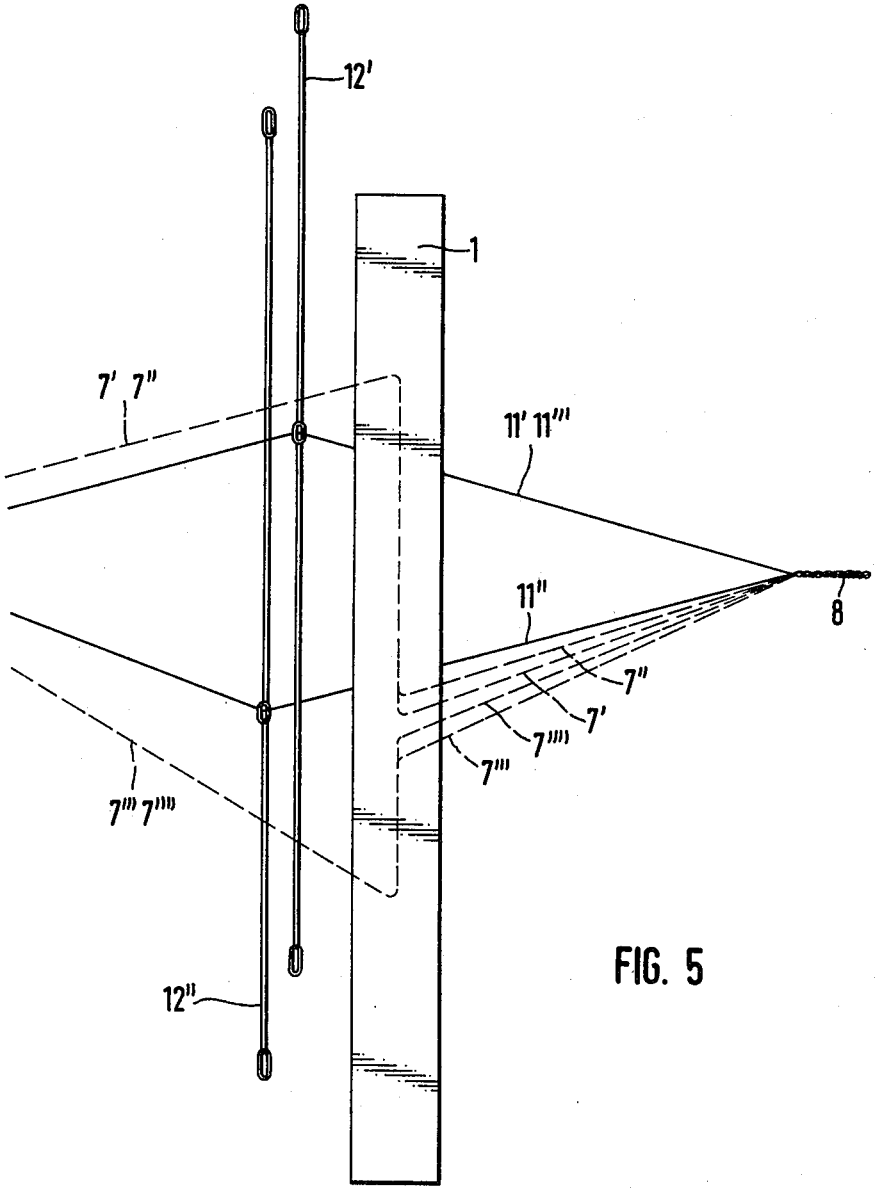
FIG. 5 is a schematic side view of the arrangement of the invention in its lower operative position illustrating also the coacting healds with eyes.
Figure 6:
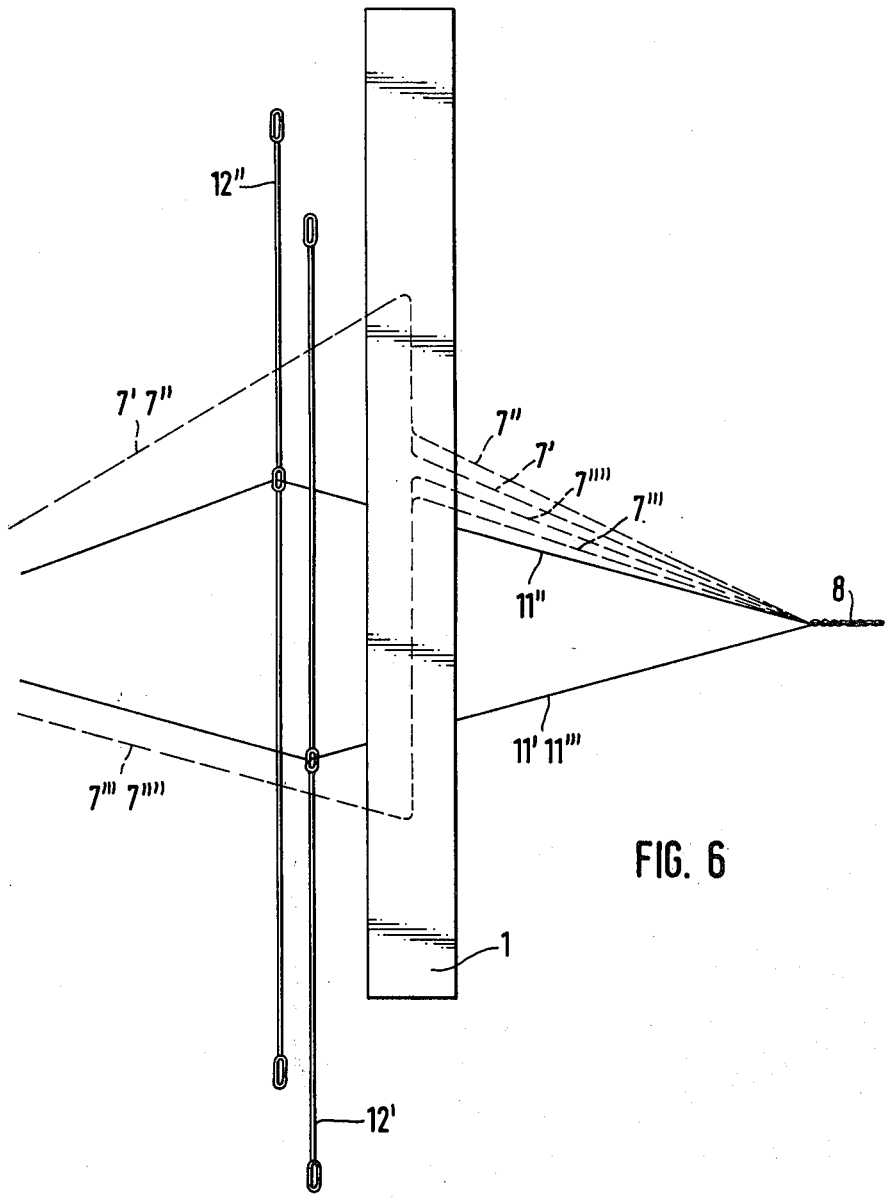
FIG. 6 is a schematic side view corresponding to FIG. 5, wherein the arrangement of the invention is shown in its upper operative position.

As can be noted from FIG. 2 there are secured onto the frame 1 bolts 3', 3''. Levers 4', 4'', 4''' and 4'''' are respectively pivotally mounted on the aforementioned bolts 3' and 3''. The levers 4', 4'', 4''' and 4'''' have respectively mounted thereon the needles 5', 5'', 5''' and 5'''' for guiding the selvage thread. The ends of the aforementioned needles are bent as is illustrated in FIG. 4 and have eyes 6 on their bend ends. Selvage threads 7', 7'', 7''' and 7'''' are guided through the needle eyes 6. These threads are shown by dashed lines FIGS. 2, 3, 5 and 6 of the drawing. The selvage threads run from the needle eyes 6 into the woven material 8 as can be noted from FIGS. 5 and 6. These selvage threads are guided respectively through eyelets 8',8'', arranged on the frame 1 (see FIG. 2) and are fed from non-illustrated spools of selvage thead into the frame 1.

The movement of the needles 5' – 5'''', and thereby the movement of the selvage threads 7' – 7'''', is controlled via rods 9', 9'', 9''' and 9'''' and the aforementioned levers 4' – 4''''. The rods 9' – 9'''' are respectively controlled by electromagnets 10', 10'', 10''' and 10'''' mounted on opposite sides of the frame 1 as shown in FIG. 2. These electromagnets 10' – 10'''' are controlled, according to need, either by the weaving shaft movement itself, or by the operating mechanism for the weaving shafts, or by separately driven means.

The needle 5' is, as is conventional, somewhat longer than the needle 5'' in order to permit an outward swinging of the selvage threads 7',7'' without mutual interference. The selvage needels 5''' and 5'''' are of different lengths for equivalent reasons.

The warp threads which are required for the production of the selvage, for example the warp threads 11', 11'', 11'''' (see FIGS. 5 and 6) can be obtained from the healds 12', 12'' mounted on their respective weaving shafts in the border region thereof. These warp threads are guided through the frame 1 in the region of the needles 5', 5'', 5''' and 5'''' and define a field 13.

Figure 7:
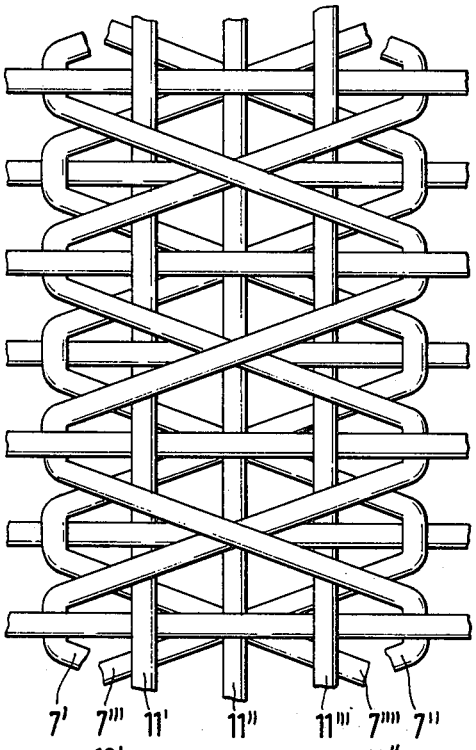
FIG. 7 is a schematic view of a woven fabric having a selvage pattern which has been provided by means of the arrangement of this invention.

There is schematically illustrated in FIG. 7 a selvage weave which has been produced by an arrangement in accordance with this invention. This weave includes four selvage threads 7', 7'', 7''', and 7'''' and three warp threads 11', 11'' and 11'''. The last-mentioned warp threads are woven in a linen weave pattern and are interwoven with the illustrated selvage threads. Two selvage threads (7''', 7'''') always alternate their position when the weave frame 1 is in its lower operative position (see FIG. 5) by virtue of a corresponding motion of their guiding needles 5''', 5''''. These selvage threads 7''' and 7'''' are respectively controlled via their needles and levers by means of the electromagnets 10''' and 10''''. The two other selvage theads 7' and 7'' change their position via their guiding needles when the frame 1 is in its upper operative position (see FIG. 6). The needles 5', 5'' and the appurtenant electromagnets 10', 10'' operate in such a case simultaneously. It is also possible to use only one electromagnet for two needles, that is when both rods 9' and 9'' are constructed as one unit. Similarly, the rods 9''' and 9'''' can be constructed as one unit in the lower portion of frame 1.

The illustrated example of a selvage for a woven fabric, in accordance with FIG. 7, includes seven weft threads. It is possible to make a more simple selvage weave by omitting two warp threads 11'', 11''' and/or the selvage threads 7'' and/or 7''' and/or 7''''. Thus, it is possible to interweave a large number of combinations of selvage and warp threads without radically changing the frame 1 and its operative motion.

Figure 8:
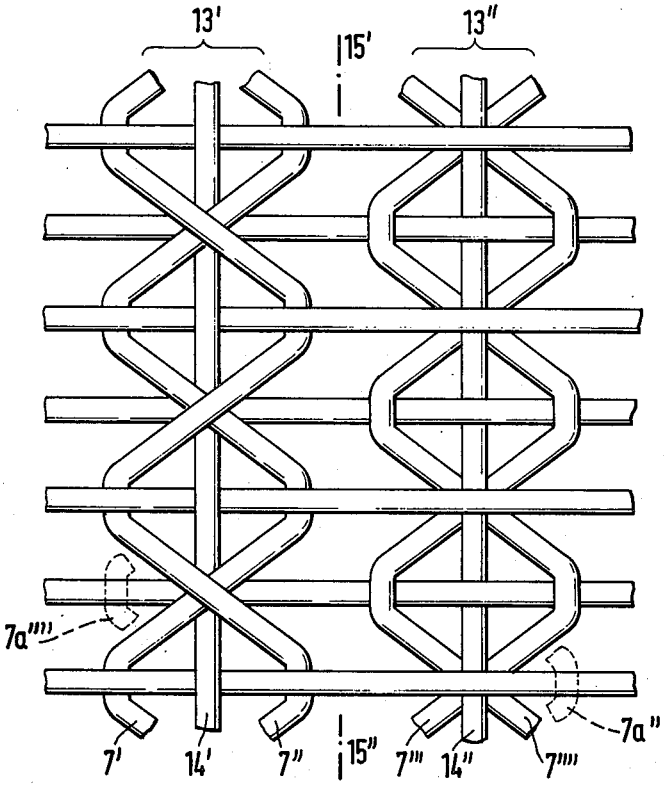
FIG. 8 is a schematic view of a woven material having two selvage patterns produced with an arrangement of this invention.

Thus, with the same basic operative motion of the selvage threads 7', 7'', 7''' and 7'''' as is shown in FIG. 7 in which one selvage cord is formed, there can be produced two selvage cords 13', 13'' as is illustrated in FIG. 8. In such a weave there are present, in lieu of the three linen-weave pattern warp threads 11', 11'', 11''', two warp threads 14', 14'', of which one warp threads 14' is held continuously in the upper operative position and the other warp thread 14'' is held continuously in the lower operative position of the weaving mechanism. The selvage thread 7'' in such a case is originally positioned by means of the needle 5'' in a path as illustrated in dashed lines (see FIG. 8), but slides due to its tension over the deeply bound warp thread 14'' and those selvage threads 7'' and 7''' which also are positioned in their lower bound positions until it reaches the position 7'' illustrated in full lines in FIG. 8.

The selvage thread 7'''' moves in the same sense. This thread is originally positioned by means of the needle 5'''' onto the position 7'''' (illustrated in dash lines in FIG. 8) and slides under the high-bound warp thread 14' and those selvage threads 7' and 7'' which are just positioned in the upper bound position, into the position shown in full lines for the selvage thread 7''''. These two selvage cords can be used for serving as borders for cutting the woven material along the lines 15', 15''.

Figure 9:
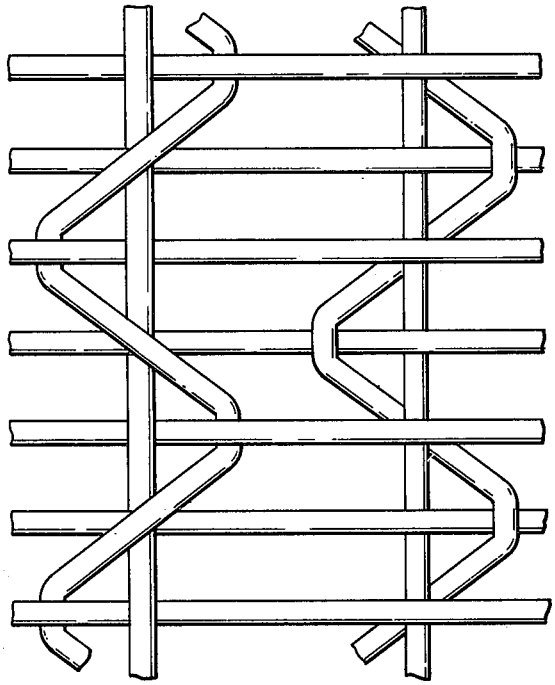
FIG. 9 is a schematic view of an alternate version of a woven material having alternate versions of selvage patterns produced with an arrangement of this invention.

Frequently it is desirable to provide a selvage in a woven material that is not too thick by producing a selvage cord as is illustrated in FIG. 9. Such a selvage cord has less threads than the selvage cords of FIG. 8. Such a selvage cord can be obtained, without changing the motion of the weaving shafts and the other elements of the arrangement, by omitting one selvage thread 7'' respectively 7''''.

Figure 10:
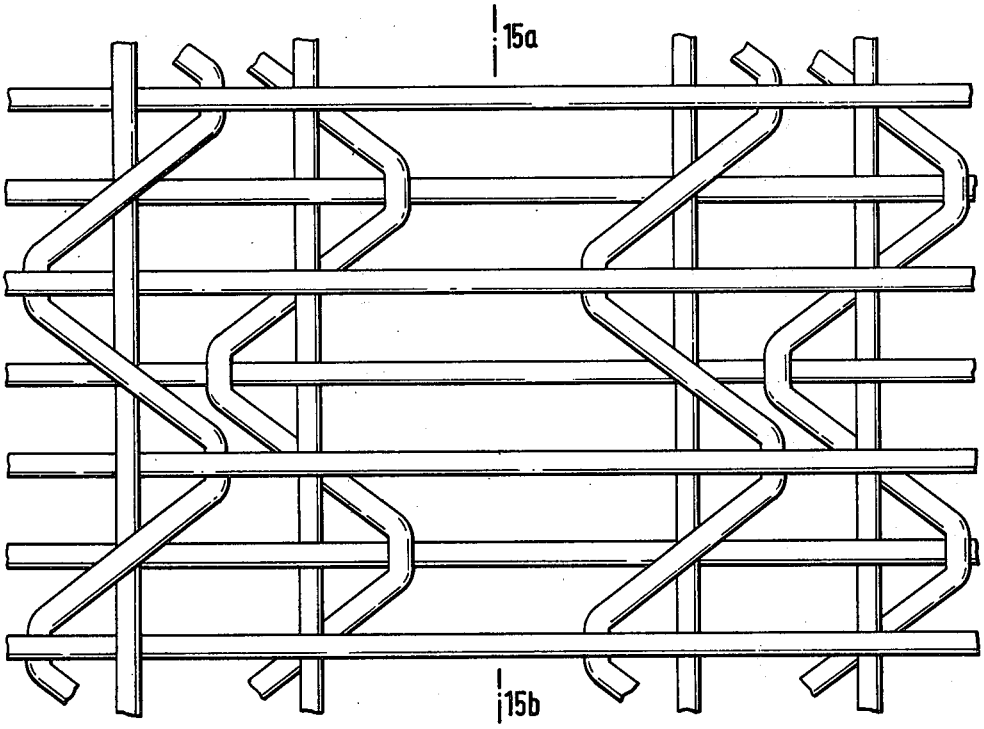
FIG. 10 is a schematic view of a woven material having four selvage patterns produced with an arrangement of this invention.

If, for example, four or more selvage cords are desired in lieu of the aforementioned two selvage cords, a weave such as is illustrated in FIG. 10 can be produced with the arrangement of this invention wherein the cutting line 15*a*, 15*b* can be used for cutting the woven material. In order to produce a selvage cord pattern as is illustrated in FIG. 10, there are, of course, required two or more frames 1 which are mounted side by side on the weave shaft frame 2. Such an arrangement has, however, the drawback that it requires a lot of space.

Figure 11:
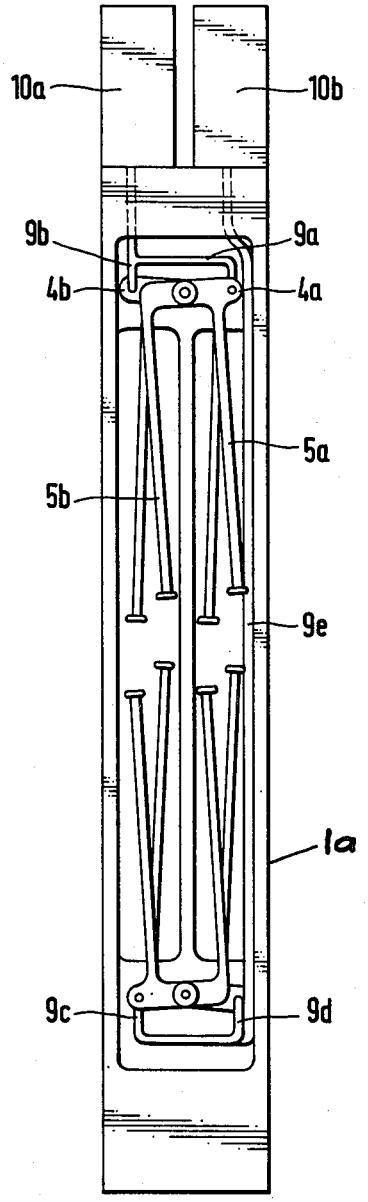
FIG. 11 is a side view of an alternate embodiment of the arrangement of this invention, said view corresponding otherwise to FIG. 2.

It is also possible, according to the basic concept of the invention, to arm each lever 4' . . . , with more than one needle (in lieu of just one needle 5'0 . . . as is illustrated in FIG. 2). For example, it is possible to have modified types of levers 4*a*, 4*b* from each of which there extend a pair of needles 5*a*, 5*b* (see FIG. 11). In this embodiment there is also illustrated, as has been mentioned hereinabove, that in order to obtain a simultaneous motion of, for example, the levers 4*a*, 4*b*, the appurtenant rods 9*a*, 9*b* can be constructed so as to form one unit and the motion of this unit can be controlled by a common electromagnet 10*a*.

There is mouted on the lower portion of frame 1*a* the unit consisting of rods 9*c*, 9*d* which is controlled by a rod 9*e* which extends from the upper portion of frame 1*a* and the motion of which is controlled by an electromagnet 10*b* mounted on the upper portion of the weave shaft. This makes for a more simple construction and eliminates the necessity of having electromagnets mounted on the lower portion of the weave shaft frame as is necessary with the embodiment of FIG. 2.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. In a weaving machine having a plurality of healds operatively mounted therein, an arrangement for producing selvages for woven fabrics, comprising in combination, a frame having an upper and a lower transverse beam, means for feeding a plurality of selvage threads, a plurality of guide needles arranged in pairs, a pivot shaft mounted in the frame for each pair of guide needles, the needles of each pair being of different lengths and being respectively pivotally mounted via their corresponding pivot shaft on said frame, at respective upper and lower locations thereon, a lever projecting from each guide needle, each needle having an eye through which a selvage thread is adapted to pass, so that a selvage thread is received from said selvage thread feeding means and is independently guided by each guide needle, the needles of each pair being mounted in staggered fashion on said transverse beams so that the selvage threads positively guided and swung out by said needles do not interfere with each other during the weaving process, a plurality of individual electromagnetic means respectively mounted on said upper and lower transverse beams, and means operatively connecting each electromagnetic means to the lever of its respective needle for controlling the pivotal movement thereof.

2. In a weaving machine having a plurality of healds operatively mounted therein, the arrangement as set forth in claim 1, wherein each pair of guide needles has a common lever, two pairs of guide needles being pivotable on a common pivot shaft, such arrangements being adapted to produce in excess of two selvage cords simultaneously in a woven fabric.

3. In a weaving machine having a plurality of healds operatively mounted therein, an arrangement for producing selvages for woven fabrics, comprising in combination, a frame having an upper and a lower transverse beam, means for feeding a plurality of selvage threads, a plurality of guide needles arranged in pairs, a pivot shaft mounted in the frame for each pair of guide needles, the needles of each pair being of different lengths and being respectively pivotally mounted via their corresponding pivot shaft on said frame at respective upper and lower locations thereon, a lever projecting at a substantial angle from each guide needle, each needle having an eye through which a selvage thread is adapted to pass, so that a selvage thread is received from said selvage thread feeding means and is independently guided by each guide needle, the needles of each pair being mounted in staggered fashion on said transverse beams so that the selvage threads are positively guided and swing out by said needles do not interfere with each other during the weaving process, a plurality of individual electromagnetic means respectively mounted on said upper and lower transverse beams, and means operatively connecting each electromagnetic means to the levers of its respective guide needle for controlling the pivotal movement thereof, said guide needles extending substantially transversely with respect to said upper and lower transverse beams and being disposed at one side of said frame, said electromagnetic means also extending substantially transversely relative to said upper and lower transverse beam and being substantially aligned with said guide needles.

* * * * *